US007169169B2

(12) United States Patent
Tucek et al.

(10) Patent No.: US 7,169,169 B2
(45) Date of Patent: Jan. 30, 2007

(54) CHIROPRACTIC ADJUSTOR APPARATUS WITH ROTATION HUB

(76) Inventors: Kevin B Tucek, 3960 E. Palm La. Building 9, Mesa, AZ (US) 85215; Steven C. Shanks, 3960 E. Palm La. Building 9, Mesa, AZ (US) 85215

( * ) Notice: Subject to any disclaimer, the term of this patent is extended or adjusted under 35 U.S.C. 154(b) by 429 days.

(21) Appl. No.: 10/735,033

(22) Filed: Dec. 12, 2003

(65) Prior Publication Data

US 2005/0131461 A1 Jun. 16, 2005

Related U.S. Application Data

(63) Continuation-in-part of application No. 10/174,622, filed on Jun. 19, 2002, now Pat. No. 6,602,211, which is a continuation-in-part of application No. 09/749,023, filed on Dec. 26, 2000, now Pat. No. 6,537,236.

(51) Int. Cl.
*A61H 1/00* (2006.01)
*A61H 23/02* (2006.01)

(52) U.S. Cl. ..... 606/239; 606/237; 601/108

(58) Field of Classification Search ..... 606/237, 606/238, 239; 601/84, 97, 101, 103, 107, 601/108, 110, 111
See application file for complete search history.

(56) References Cited

U.S. PATENT DOCUMENTS

| | | | | |
|---|---|---|---|---|
| 4,716,890 | A | 1/1988 | Bichel | |
| 4,841,955 | A | 6/1989 | Evans | |
| 6,537,236 | B2 | 3/2003 | Tucek | |
| 6,602,211 | B2 * | 8/2003 | Tucek | 601/97 |
| 6,805,700 | B2 * | 10/2004 | Miller | 606/239 |
| 6,875,186 | B2 * | 4/2005 | Tucek et al. | 601/108 |

* cited by examiner

*Primary Examiner*—Quang D. Thanh
(74) *Attorney, Agent, or Firm*—Etherton Law Group, LLC; Sandra L. Etherton

(57) ABSTRACT

A force-transmitting head for a chiropractic adjustor apparatus includes a hub which is rotatable in a cavity formed in the head and non-rotatably attached to a reciprocating shaft of the apparatus. A rotation pin extends through the body into the cavity and engages a track formed in the hub. Reciprocating movement of the shaft and hub causes a rotational movement of the body with passage of the rotation pin along the track. Also, a chiropractic adjustor apparatus incorporating the force-transmitting head.

13 Claims, 3 Drawing Sheets

CHIROPRACTIC ADJUSTOR APPARATUS WITH ROTATION HUB

CROSS-REFERENCE TO RELATED APPLICATIONS

This application is a continuation-in-part of U.S. application Ser. No. 10/174,622 filed Jun. 19, 2002, now U.S. Pat. No. 6,602,211 which in turn is a continuation-in-part of U.S. application Ser. No. 09/749,023 filed Dec. 26, 2000 and now issued as U.S. Pat. No. 6,537,236.

FIELD OF THE INVENTION

The present invention generally relates to a rotation hub for a chiropractic adjustor apparatus used to apply vibratory energy or force to a patient. More particularly, the invention relates to a chiropractic adjustor apparatus that allows limited, controlled rotation of a force-transmitting head during use.

BACKGROUND OF THE INVENTION

Chiropractic adjustments of the spinal vertebrae of a body involve the application of pressure or force in a known manner directly to the body by the hands of a chiropractor or by a chiropractic adjustor apparatus. Examples of such chiropractic adjustor apparatuses found in the prior patent art are those disclosed in U.S. Pat. No. 4,716,890 to Bichel and U.S. Pat. No. 4,841,955 to Evans et al.

Another example of a prior art chiropractic adjustor apparatus is described in the Applicant's earlier patent, U.S. Pat. No. 6,537,236. This patent describes an apparatus that includes a housing, a handle on the housing, a trigger reciprocally mounted to the handle, an electronic control module provided in the handle and activated by depression and release of the trigger, and an elongated force-transmitting shaft reciprocally mounted through the housing. An electromagnetic drive mechanism is disposed in the interior cavity of the housing and connected electrically to the electronic control module. The chiropractic adjustor is operable by the actuation of the trigger and the return action of a compressible spring near the rear portion of the housing, causing the shaft to transmit vibratory energy to the human body.

The electromagnetic drive mechanism includes a spool with stationary electrical windings supported in the interior cavity of the housing and a stator mounted on the shaft and disposed within a bore of the spool in an electromagnetically coupled relationship with the electrical windings about the spool. Depressing the trigger activates the electrical control module to apply predetermined pulses to the electrical windings so as to actuate the stator and thus the shaft into a repetitive reciprocal vibratory type of movement along a longitudinal axis of the shaft and relative to the housing.

One operation performed by a chiropractor is manipulation of the spine. A U-shaped force-transmitting head is commonly fitted to the shaft for this operation. The U-shaped head is placed to straddle the spine such that one arm of the U is on each side of the spine.

During operation, many of the prior art devices tend to rotate, or twist, out of the user's grip, as a result of the rotational components of the force exerted on the shaft by the electromagnetic drive mechanism, requiring the operator to exert significant effort to hold the device substantially perpendicular to the patient's vertebrae. The earlier patent of the Applicant, U.S. Pat. No. 6,537,236, describes a mechanism to resist such rotation so that the device can be held in the proper position along the patient's spine. The mechanism described is a pin mounted across a forward portion of the shaft that moves with the shaft. The pin moves in a slot formed in a sleeve attached to the housing of the adjustor. The pin and slot combination allows the shaft to move longitudinally but prevents rotation. The description in U.S. Pat. No. 6,537,236 is incorporated herein by reference.

It has been found that it is desirable to allow some degree of rotation of the force-transmitting head during operation of the chiropractic adjustor. Therefore, it is an object of this invention to provide a device that allows a controlled amount of rotation of the head during operation. It is a further object of this invention to provide a head that depresses a controlled distance while rotating a controlled distance. It is a further object to provide a force-transmitting head that can be rotated to the right or left a desired amount.

SUMMARY OF THE INVENTION

In one form the invention resides in a force-transmitting head for a chiropractic adjustor apparatus, the head comprising a body; a cavity formed in one end of the body; a hub rotatable in the cavity relative to the body; at least one track formed in the hub; and at least one rotation pin extending from the body into the cavity and engaging the track such that longitudinal movement of the hub relative to the body causes rotational movement of the body with passage of the rotation pin along the track. In the preferred embodiment, the track is substantially L shaped.

In a further form the invention resides in a chiropractic adjustor apparatus having a housing having a central interior cavity; an electromagnetic drive mechanism mounted in the interior cavity of the housing; a shaft extending through the electromagnetic drive mechanism and extending beyond the housing; means for actuating the electromagnetic drive mechanism to cause repetitive reciprocal movement of the shaft along a longitudinal axis of the shaft and relative to the housing; and a force-transmitting head comprising a body; a cavity formed in one end of the body; a hub attached to the shaft and rotatable in the cavity relative to the body; at least one track formed in the hub; and at least one rotation pin extending from the body into the cavity and engaging the track such that repetitive reciprocal movement of the shaft and hub causes rotational movement of the body with passage of the rotation pin along the track.

DETAILED DESCRIPTION OF THE INVENTION

Figures 1, 2:
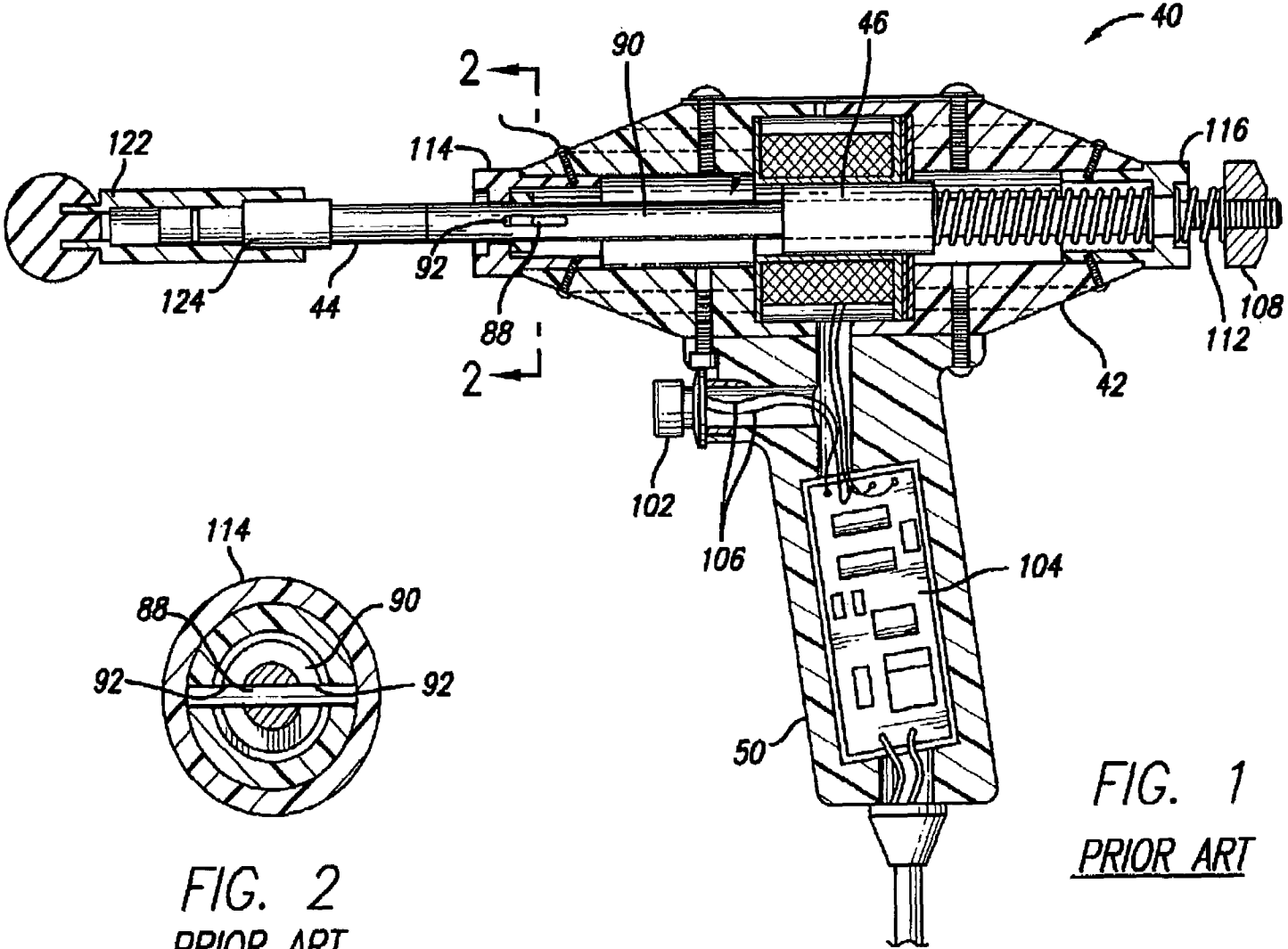
FIG. 1 PRIOR ART
FIG. 2 PRIOR ART
FIG. 1 is a longitudinal sectional view of a prior art chiropractic adjustor apparatus.
FIG. 2 is an enlarged cross sectional view of the apparatus taken along line 2—2 of FIG. 1.

Referring to the drawings and particularly to FIG. 1 and FIG. 2, there is illustrated a chiropractic adjustor apparatus of the prior art, generally designated 40. The apparatus 40 basically includes a housing 42 with a handle 50. An electromagnetic drive mechanism 46 located within the housing 42 is actuated by a trigger 102 that is electrically connected to an electronic control module 104 and hence to electromagnetic drive mechanism 46 by wires 106. Depression of the trigger 102 actuates the drive mechanism 46 to cause repetitive reciprocal vibratory movement of the shaft 44 relative to the housing 42.

A pin 88 is mounted through the forward portion of the shaft 44 in a transverse relationship thereto. A sleeve 90 extends about and along the forward portion of the shaft 44 and has a longitudinal slot 92 receiving each end of the pin 88 such that the shaft 44 can undergo longitudinal movement through the sleeve 90 relative to the housing 42 but cannot undergo rotation about a longitudinal axis of the shaft 44. Front plug 114 provides a stop which is abutted by each end of pin 88. The arrangement of the pin 88, sleeve 90, slot 92 and front plug 114 is shown most clearly in FIG. 2.

The force applied by the elongated shaft 44 can be adjusted by rotation of knob 108 disposed on a rear end of the shaft 44 which cooperates with first and second springs 110, 112 disposed on either side of rear plug 116. By turning the knob 108 the return force imposed by the springs 110, 112 on the shaft 44 can be increased or decreased to thereby adjust the amount of vibratory force applied to the human body at the front end of the shaft 44.

Figure 4:
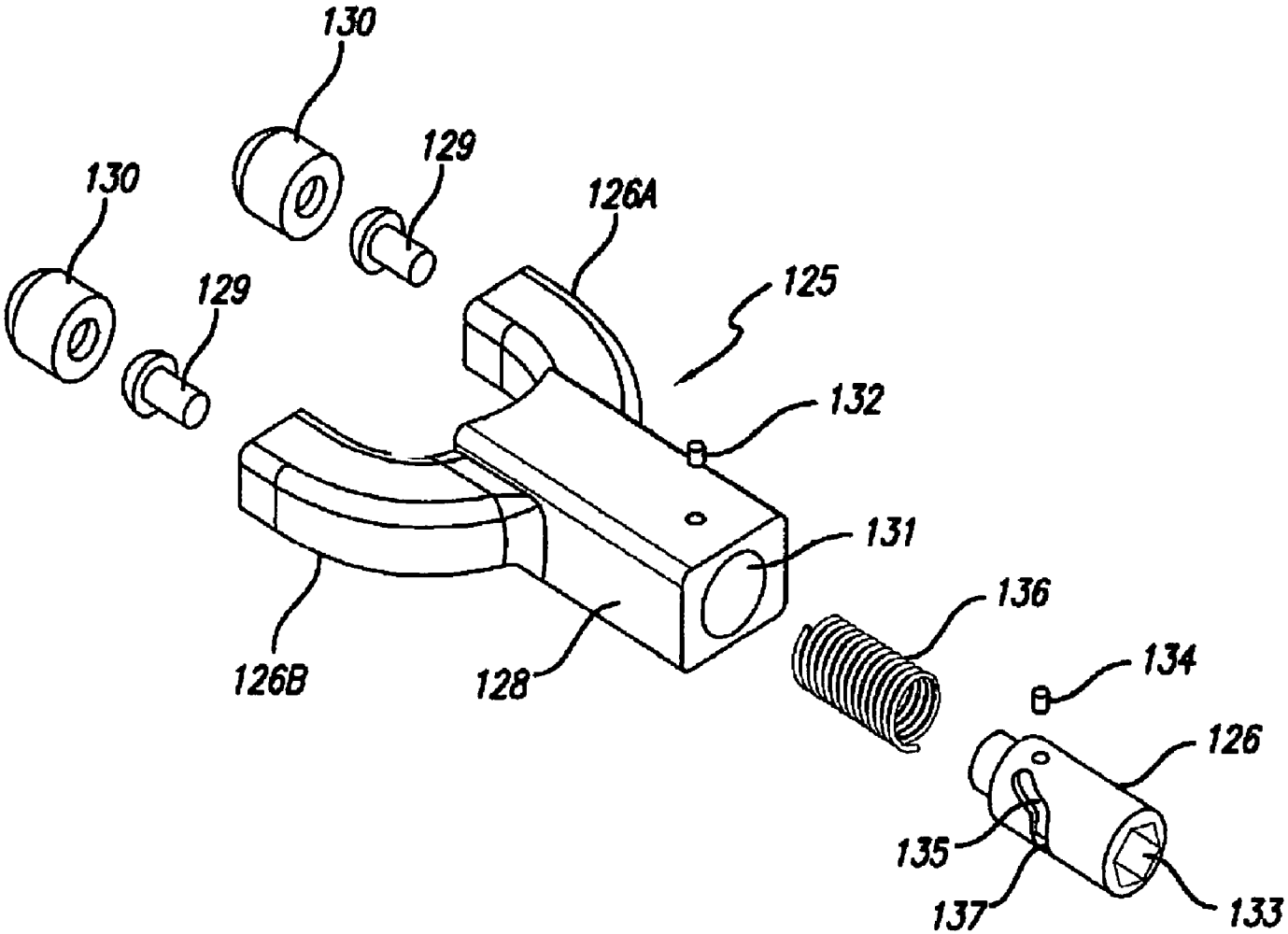
FIG. 4 is an exploded perspective view of the improved force-transmitting head of FIG. 3.

A plurality of force transmitting heads of different configurations, such as 122, are adapted to be fitted to a hex shaped segment 124 on the front end of the shaft 44 and placed against a part of the human body to be treated. Other polygonal shapes may be used to resist rotation, as explained in the prior art. The different configurations of the heads 122 allow for the application of force in different ways to the human body. The head shown in FIG. 1 is a simple ball and the head shown in FIG. 4 is a U shape. The adjustor apparatus 40 has a mode of operation similar to that of a jack hammer or the like. In the case of the apparatus 40, vibratory impacts are transmitted at the front end of the shaft 44 by the selected one of the force transmitting heads 122 when it is placed against the desired part of the human body.

Figure 3:
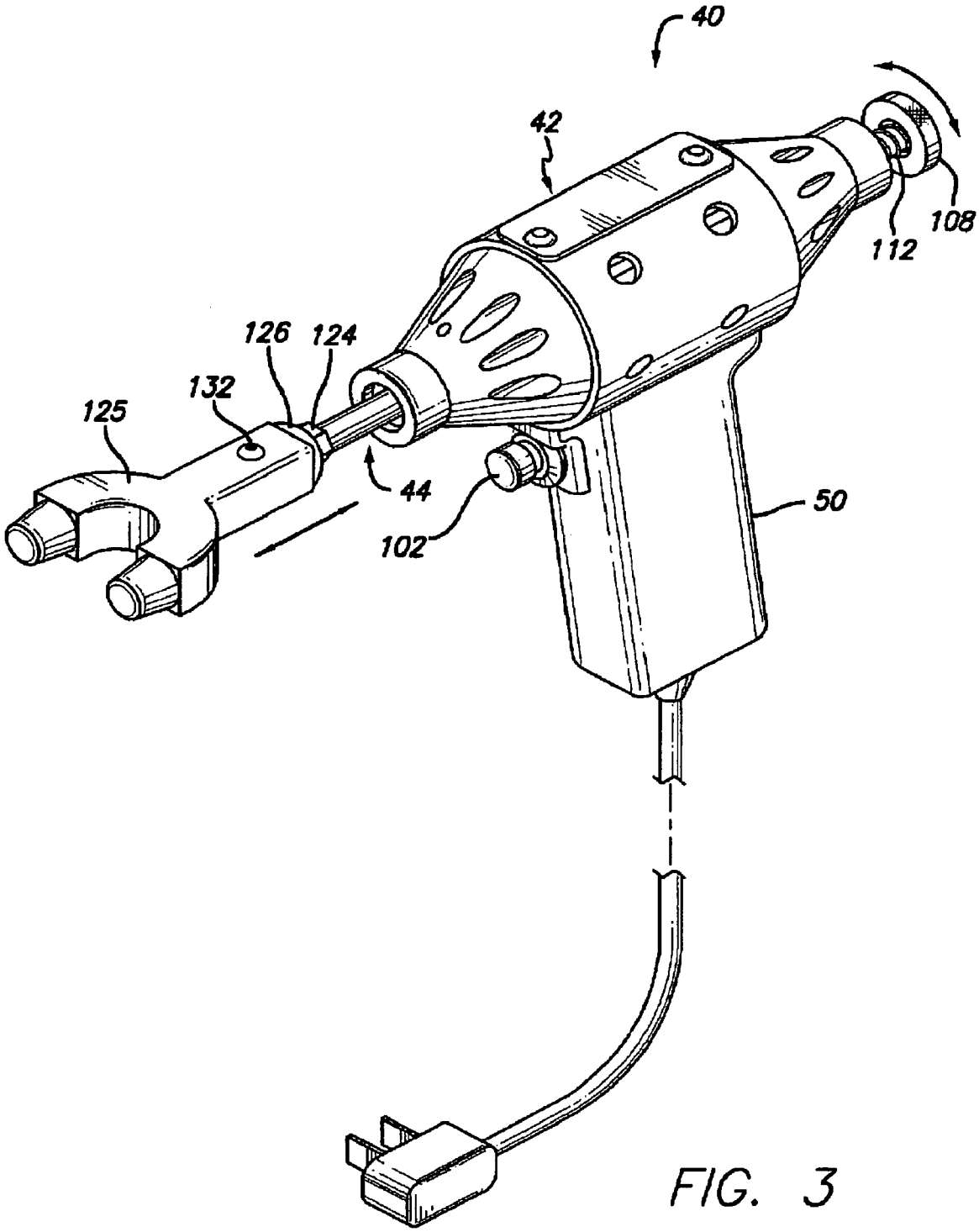
FIG. 3 is a perspective view of a chiropractic adjustor apparatus with one embodiment of an improved force-transmitting head according to the present invention.

Referring now to FIG. 3 there is shown a chiropractic adjustor apparatus 40 having a shaft 44 with a hex shaped segment 124 at one end. An improved force-transmitting head 125 is shown attached to the shaft 44 via a rotation hub 126 which is held in the head 125 by rotation pin 132.

Detail of the improved force-transmitting head is shown in the exploded perspective view of FIG. 4. In the preferred embodiment, a U-shaped head is used. The U-shaped head 125 has first and second arms 126A, 126B extending from a body 128. Each arm 126A, 126B terminates with a screw 129 covered by a rubber pad 130, which contacts the patient. The body 128 has a cavity 131 which receives a hub 126. In the preferred embodiment, the hub 126 has a hex shaped cavity 133 that fits onto the hex shaped element 124 of the shaft 44 of the chiropractic adjustor apparatus 40. A set screw 134 locks the hub 126 to the shaft 44. The hub 126 may be mounted on the shaft in any of the six positions defined by the mating of the hex-shaped cavity with the hex-shaped shaft, allowing the user to index the head at six different positions. Of course, the cavity 133 and element 124 may have complementary shapes other than hexagonal. For example, if a square-shaped cavity with mated square shaft are used, the user will have a choice of four head positions from which to mount the hub to the shaft.

It will be appreciated that other means of locking the hub 126 to the shaft 44 will also be suitable. For instance, the hub 126 may be held directly on the shaft 44 with a pin that passes through the hub and the shaft. It will also be appreciated that heads having other than U shapes may be implemented with the improved hub.

A rotation pin 132 passes through the body 128 into the cavity 131, and hence into a track 135 formed in the hub 126. The track 135 is shaped so that relative longitudinal movement between the hub 126 and the head 125 causes a relative rotation due to the passage of the rotation pin 132 in the track 135. Alternatively the pin may be an integral extension from the body 128 into the track 135. A bias means, such as a spring 136, biases the head 125 towards an end of the track 135. It will be appreciated that other resiliently deformable bias means, such as a rubber block, will also be appropriate.

Since the hub 126 is keyed to the shaft 44 by the matching cavity 133 and element 124, the hub 126 will remain rotationally stationary relative to the chiropractic adjustor apparatus 40 and the head 125 will rotate as it vibrates. The exact amount of relative rotation of the head 125 will depend upon the shape of the track 135 and the position of the rotation pin 132 in the track 135. Increased pressure applied by the user will compress the bias means 136 thus moving the rotation pin 132 into a different portion of the track 135. It is envisaged that a range of hubs 126 may be available with each head 125 and a suitable hub chosen for a certain chiropractic procedure.

As shown in the preferred embodiment of FIG. 4, the track 135 may end in a straight section 137 generally perpendicular to the direction of vibration of the shaft 44, thus forming a substantially L-shaped track. The straight section 137 allows the user to lock off the rotation of the head 125 by applying sufficient force to compress the biasing means 136 and twisting the head 125 so the rotation pin 132 sits in the straight section 137. Arcuate-shaped tracks may also be implemented.

The preferred embodiment has been described with reference to a single track 135 and rotation pin 132. The track shown in the preferred embodiment of FIG. 4 allows the head to rotate to the left and back during operation. It may be convenient to provide a second complementary track opposite the first track to enable the user to twist the head to either the right or left. In such case, a second rotation pin will extend into the cavity to engage the second track formed in the hub.

Although the invention has been described by reference to the application to an electronic chiropractic adjustor, it will be appreciated by persons skilled in the art that the rotation hub is not limited by the actuation mechanism of the chiropractic adjustor. Thus the invention may also be applied to pneumatic chiropractic adjustors, such as those described in the prior art of Bichel referred to earlier.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A force-transmitting head far a chiropractic adjustor apparatus comprising:

a) a body;

b) a cavity formed in one end of the body;

c) a hub rotatable in the cavity relative to the body;

d) at least one track formed in the hub; and e) at least one rotation pin extending from the body into the cavity and engaging said at least one track such that longitudinal movement of the hub relative to the body allows rotational movement of the body with passage of the rotation pin along the track.

2. The force-transmitting head according to claim 1 further comprising a biasing means located between the hub and the body to bias the pin towards one end of the track.

3. The force-transmitting head according to claim 2 wherein the biasing means is a spring.

4. The force-transmitting head according to claim 1 wherein the rotation pin extends through a wall of the body.

5. The force-transmitting head of claim 1 wherein the track is substantially L-shaped.

6. The force-transmitting head of claim 5 further comprising a biasing means wherein the compression of the biasing means moves the hub relative to the rotation pin until the rotation pin is positioned in a portion of the L shape that avoids rotational movement of the body with longitudinal movement of the hub.

7. The force-transmitting head of claim 1 wherein the track has a shape such that the degree of rotational movement of the body vanes with the longitudinal movement of the hub relative to the body.

8. A chiropractic adjustor apparatus comprising:

a) a housing having a central interior cavity;

b) an electromagnetic drive mechanism mounted in the interior cavity of the housing;

c) a shaft extending through the electromagnetic drive mechanism and extending beyond the housing;

d) means for actuating the electromagnetic drive mechanism to cause repetitive reciprocal movement of the shaft along a longitudinal axis of the shaft and relative to the housing; and e) a force-transmitting head comprising:

(i) a body;

(ii) a cavity formed in one end of the body;

(iii) a hub attached to the shaft and rotatable in the cavity relative to the body;

(iv) at least one track formed in the hub; and (v) at least one rotation pin extending from the body into the cavity and engaging said at least one track such that repetitive reciprocal movement of the shaft and hub causes rotational movement of the body with passage of the rotation pin along the track.

9. The chiropractic adjustor apparatus according to claim 8 wherein the shaft includes a shaped element and the hub includes a complementary shaped aperture and the hub is attached to the shaft by aligning the shaped aperture with the shaped element.

10. The device according to claim 9 wherein the shaped element and the shaped aperture are polygonal.

11. The chiropractic adjustor apparatus according to claim 10 wherein the shaped element and the shaped aperture are hexagonal.

12. The chiropractic adjustor apparatus according to claim 8 further comprising a locking screw that attaches the hub to the shaft.

13. The chiropractic adjustor apparatus according to claim 8 wherein the adjustor is electromechanical.

* * * * *